US012344974B1

(12) United States Patent
Lin et al.

(10) Patent No.: US 12,344,974 B1
(45) Date of Patent: Jul. 1, 2025

(54) CIRCULAR KNITTING MACHINE WITH REAL-TIME PROMPT OF KNITTING MACHINE STATUS

(71) Applicant: PAI LUNG MACHINERY MILL CO., LTD., New Taipei (TW)

(72) Inventors: Yu-Sheng Lin, New Taipei (TW); Chang-Lin Yang, New Taipei (TW); Po-Wei Huang, New Taipei (TW); Wei-Fan Lai, New Taipei (TW)

(73) Assignee: PAI LUNG MACHINERY MILL CO., LTD., New Taipei (TW)

( * ) Notice: Subject to any disclaimer, the term of this patent is extended or adjusted under 35 U.S.C. 154(b) by 0 days.

(21) Appl. No.: 18/743,762

(22) Filed: Jun. 14, 2024

(30) Foreign Application Priority Data

Apr. 29, 2024 (TW) ..... 113116011

(51) Int. Cl.
*D04B 35/20* (2006.01)
*D04B 15/00* (2006.01)

(52) U.S. Cl.
CPC ..... *D04B 35/20* (2013.01); *D04B 15/00* (2013.01)

(58) Field of Classification Search
CPC ..... D04B 35/10; D04B 35/20; D04B 15/00; G01N 21/8903; G01N 21/8914; G01N 2021/8927; G01N 21/898; G01N 21/8983
USPC ..... 66/166, 157; 356/238.1, 238.2, 238.3
See application file for complete search history.

(56) References Cited

U.S. PATENT DOCUMENTS 3,496,739 A * 2/1970 Linden ..... D04B 35/10 66/157
4,249,081 A * 2/1981 Cole ..... G01N 21/8983 250/559.47
4,464,913 A * 8/1984 Rosenquist ..... D04B 35/14 66/166
4,748,334 A * 5/1988 Kobayashi ..... G01N 21/8983 66/166
4,953,400 A * 9/1990 Bossuyt ..... D04B 35/10 356/238.1

(Continued)

FOREIGN PATENT DOCUMENTS

CN 102778414 A 11/2012
CN 102967606 A 3/2013

(Continued)

*Primary Examiner* — Danny Worrell
(74) *Attorney, Agent, or Firm* — Muncy, Geissler, Olds & Lowe, P.C.

(57) ABSTRACT

A circular knitting machine with real-time prompt of a knitting machine status. The circular knitting machine includes a base, a cloth rolling machine that rotates relative to the base during knitting operation process, a main camera module fixed on the base, and an auxiliary camera module fixed on the base and disposed close to the main camera module. The main camera module includes a first central axis, and the main camera module takes pictures of a tubular fabric knitted by the circular knitting machine. The auxiliary camera module includes a second central axis intersecting with the first central axis. The auxiliary camera module and the main camera module face a same side of the tubular fabric. A startup timing of the auxiliary camera module only occurs when one of the plurality of connecting rods passes between the main camera module and the tubular fabric.

13 Claims, 9 Drawing Sheets

(56) References Cited

U.S. PATENT DOCUMENTS

| | | | | | |
|---|---|---|---|---|---|
| 5,133,198 | A * | 7/1992 | Bachmann | D04B 35/20 | 66/166 |
| 5,283,623 | A * | 2/1994 | Muhlberg | G01N 21/8983 | 356/238.2 |
| 6,219,136 | B1 * | 4/2001 | Kuo | G01N 21/8983 | 66/157 |
| 11,798,154 | B2 * | 10/2023 | Martins Loureiro | H04N 23/54 | |

FOREIGN PATENT DOCUMENTS

| | | | |
|---|---|---|---|
| CN | 103451846 | A | 12/2013 |
| CN | 103604809 | A | 2/2014 |
| CN | 104178907 | A | 12/2014 |
| CN | 108364291 | A | 8/2018 |
| CN | 108921819 | A | 11/2018 |
| CN | 109696442 | A | 4/2019 |
| CN | 110389130 | A | 10/2019 |
| CN | 114808260 | A | 7/2022 |

* cited by examiner

CIRCULAR KNITTING MACHINE WITH REAL-TIME PROMPT OF KNITTING MACHINE STATUS

FIELD OF THE INVENTION

The invention provides a circular knitting machine, more particularly a circular knitting machine capable of determining a status of knitting needles through knitting results of a tubular fabric during knitting operations.

BACKGROUND OF THE INVENTION

The knitting quality of a circular knitting machine is equivalent to whether there are defects in the cloth surface condition of the fabric, and the occurrence of defects is closely related to the stitch status of the knitting needles on the circular knitting machine. When the lower edge of the stitch of one of the knitting needles is worn too much, the push-up height of one of the knitting needles will not reach the expected height, resulting in the following: the needle latch cannot be fully opened; the old yarn loop is not cleared (knitting needles are knitting with double yarns incorrectly), and the needle hook cannot hook the new yarn (holes appear in the fabric). On the other hand, when the upper edge of the stitch of one of the knitting needles is worn too much, the following will happen: the old yarn loop cannot be reliably detached (in addition to holes produced in the fabric, abnormal line textures can be found visually on the fabric after knitting); the knitted yarn loops are smaller than those knitted in the previous stage (abnormal line textures can be found visually on the fabric).

Although there are technical solutions for detecting fabric quality currently, such as disclosed in the patents CN102778414A, CN102967606A, CN103604809A, CN103451846A, CN108364291A, CN108921819A, CN109696442A, CN110389130A, the time point for quality inspection of knitting is after the circular knitting machine has completed knitting in the aforementioned prior art, even if a defect is found in the fabric, it is impossible to judge which part of the knitting needles of the circular knitting machine needs to be replaced. As a result, after the producers learn that the fabric is defective, a common practice is to replace all the knitting needles on the circular knitting machine, a number of knitting needles on a circular knitting machine generally ranges from 1500 to 2640, and a number of knitting needles that are replaced at one time is too many. A condition assessment of all the knitting needles is not cost-effective in terms of time. This will result in a waste of resources and a disguised increase in production costs for producers.

Furthermore, U.S. Pat. No. 4,748,334A, CN114808260A, and CN104178907A disclose a circular knitting machine with a cloth rolling mechanism. When the knitting operation is in progress, the cloth rolling mechanism will rotate and simultaneously wind up the fabric that has been woven. At this time, the connecting rods disposed in the cloth rolling mechanism will affect image recognition of the outer side of the tubular fabric, so this problem needs to be improved.

SUMMARY OF THE INVENTION

A main object of the invention is to solve the problem occurred when the conventional circular knitting machines equipped with a cloth rolling mechanism perform image recognition on an outer side of a tubular fabric.

In order to achieve the above object, the invention provides a circular knitting machine with real-time prompt of a knitting machine status. The circular knitting machine includes a base, a needle cylinder that rotates relative to the base during a knitting operation process, and a cloth rolling machine that rotates with the needle cylinder relative to the base during the knitting operation process, the cloth rolling machine comprises a cloth rolling rod and a plurality of connecting rods connected to the cloth rolling rod, and the plurality of connecting rods are displaced relative to the base when the cloth rolling machine rotates. Further, the circular knitting machine includes a main camera module fixed on the base, and an auxiliary camera module fixed on the base and disposed close to the main camera module. The main camera module includes a first central axis, and the main camera module takes pictures of a tubular fabric rotating with the needle cylinder. The auxiliary camera module includes a second central axis intersecting with the first central axis, and a startup timing of the auxiliary camera module only occurs when one of the plurality of connecting rods passes between the main camera module and the tubular fabric. A status of the circular knitting machine is determined by data generated by the main camera module and the auxiliary camera module.

In one embodiment, the circular knitting machine includes an encoder generating a plurality of pulse wave signals when the needle cylinder rotates, and a plurality of shooting signals of the main camera module and the auxiliary camera module are generated based on counting the plurality of pulse wave signals.

In one embodiment, the plurality of shooting signals of the main camera module are generated by counting a factor of a total number of the plurality of pulse wave signals when the needle cylinder performs one revolution.

In one embodiment, a value of a number of shots taken by the main camera module can evenly divide a central angle, and exactly divisible a total number of knitting needles in the needle cylinder. In one embodiment, the circular knitting machine includes a data processor that receives a plurality of image data provided by the main camera module and the auxiliary camera module, and the data processor is configured to perform an image comparison between one of the plurality of image data with another one of the plurality of image data located on a same vertical line of the tubular fabric.

In one embodiment, each of the plurality of image data comprises a plurality of loop images, parts of the plurality of loop images located on the same column correspond to one of knitting needles on the circular knitting machine, and numbers of the plurality of loop images included in the plurality of image data generated by the main camera module are similar or equal to provide the plurality of image data being compared with each other, and numbers of the plurality of loop images included in the plurality of image data generated by the auxiliary camera module are similar or equal to provide the plurality of image data being compared with each other.

In one embodiment, when the needle cylinder performs one revolution, a total longitudinal length of the plurality of loop images of the image data respectively generated by the main camera module and the auxiliary camera module have a proportional relationship with a length of the fabric drop amount of the circular knitting machine.

In one embodiment, the circular knitting machine comprises another main camera modules, the two main camera modules face an outer side and an inner side of the tubular fabric respectively, one of the two main camera modules facing the outer side is disposed adjacent to the auxiliary camera module, and the auxiliary camera module faces the outer side of the tubular fabric.

In one embodiment, the two main camera modules are different horizontal heights.

In one embodiment, the base includes a suspension arm provided thereon for disposing of one of the two main camera modules facing the inner side of the tubular fabric.

In one embodiment, the data processor receives a plurality of image data provided by the two main camera modules and the auxiliary camera module, and the data processor is configured to perform an image comparison between one of the plurality of image data with another one of the plurality of image data located on a same in vertical line of the tubular fabric.

Through implementation of the foregoing technology of the invention, compared with the prior art, the invention has the following characteristics: the circular knitting machine of the invention solves problems caused by poor quality detection in the cloth rolling machine through the arrangement of the main camera module and the auxiliary camera module; data generated by the main camera module and the auxiliary camera module of the invention can be used to understand a status of the circular knitting machine, clearly distinguishing which the knitting needles on the circular knitting machine may have problems, thereby solving the problem of waste caused by replacing the knitting needles in batches in the past; in addition, the invention enables an operator of the circular knitting machine to quickly respond with repair and avoid discovering defects in finished products only after the knitting operation is completed.

DETAILED DESCRIPTION OF THE PREFERRED EMBODIMENTS

Figure 1:
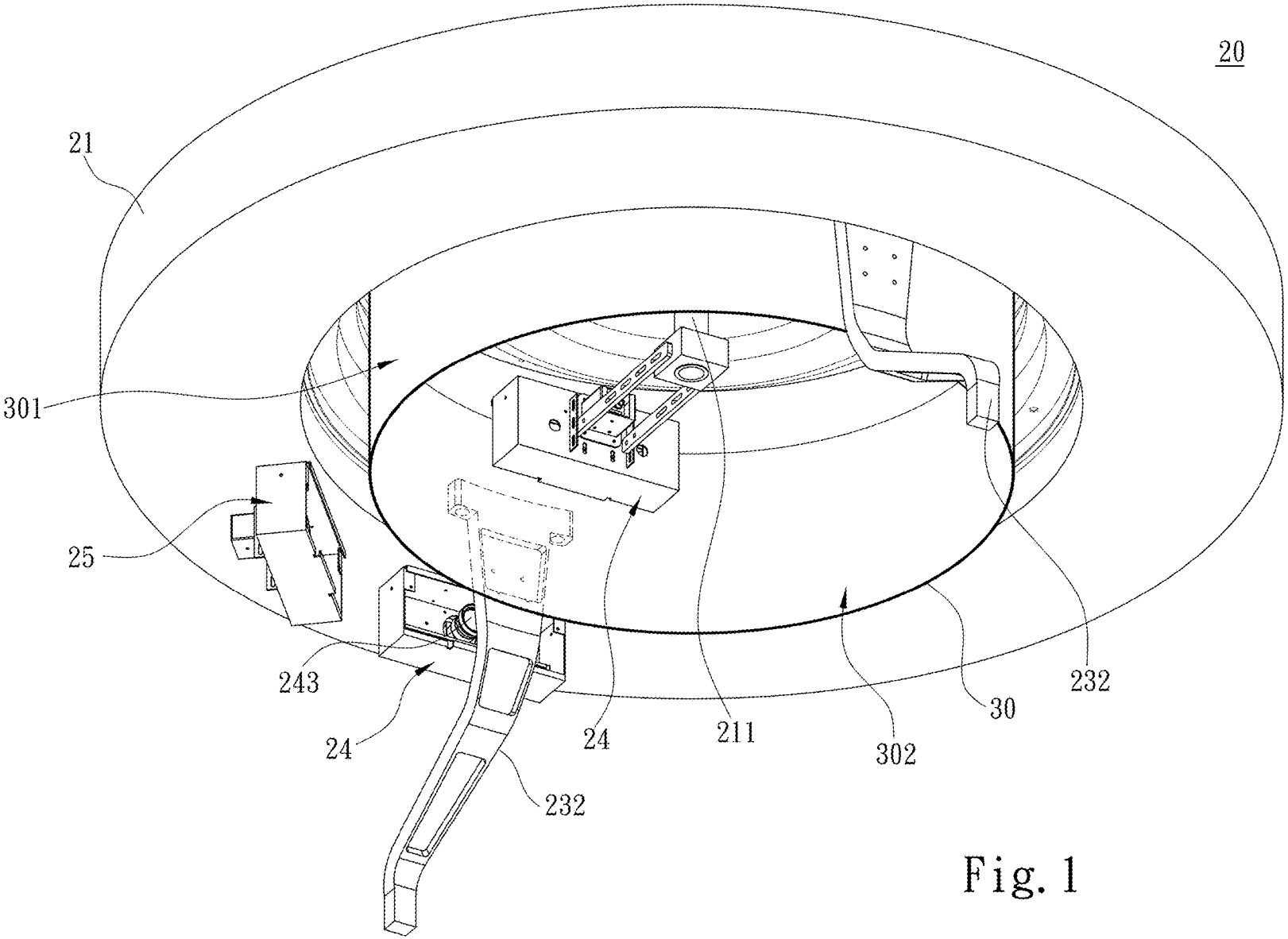
FIG. 1 is a perspective view of partial structures of a circular knitting machine of the invention.
Figure 2:
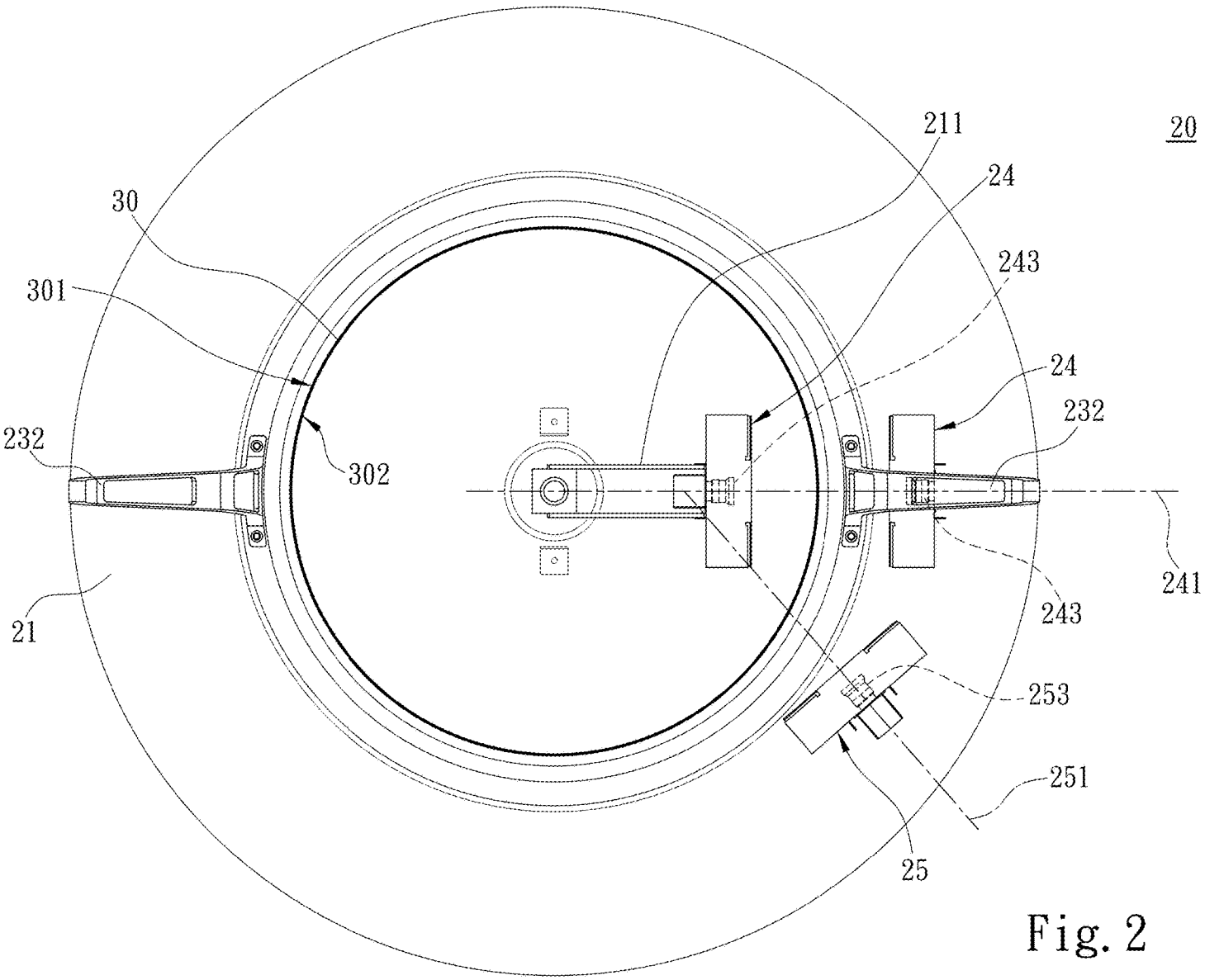
FIG. 2 is a bottom view of partial structures of the circular knitting machine of the invention.
Figure 3:
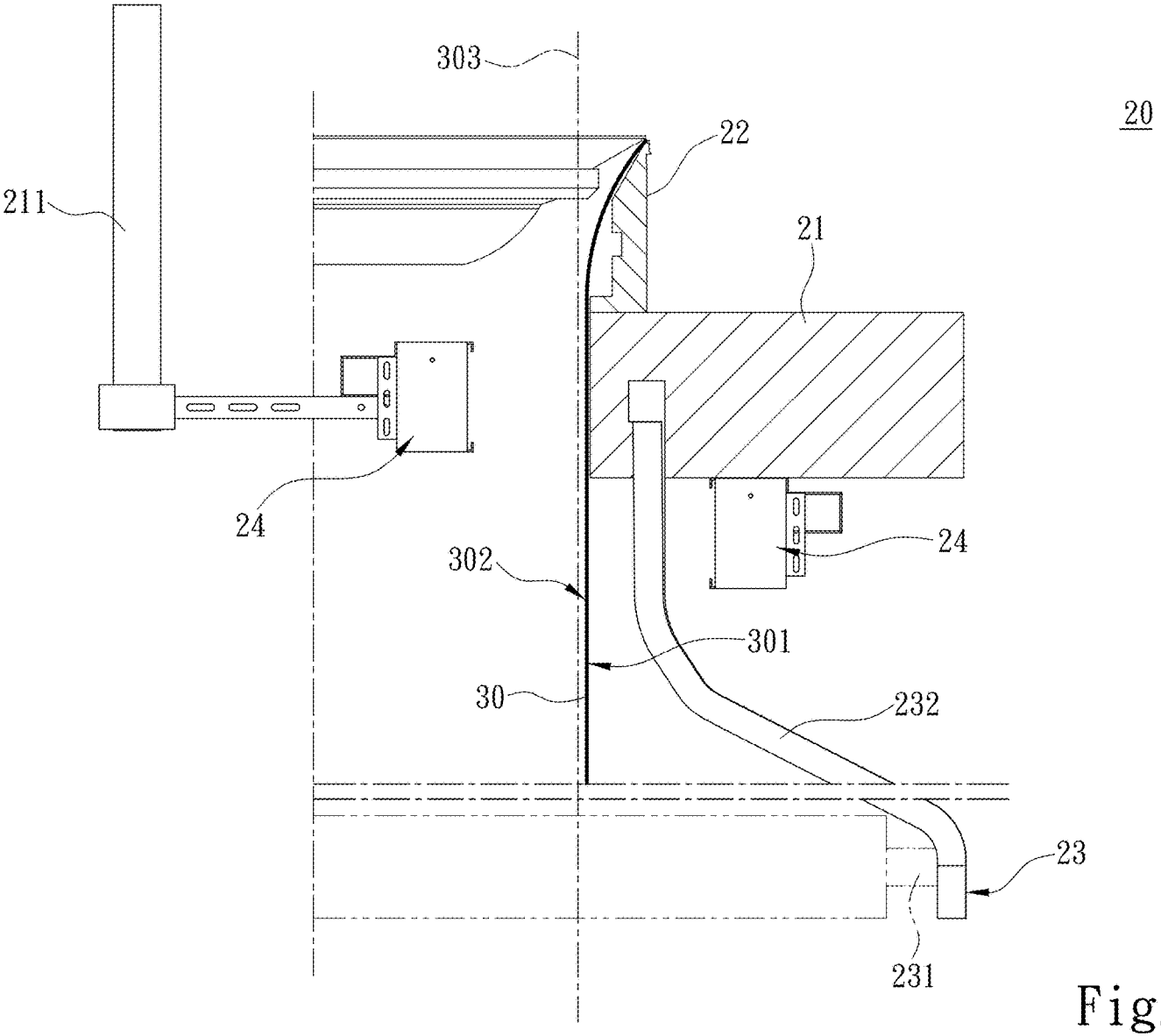
FIG. 3 is a cross-sectional view of partial structures of the circular knitting machine of the invention.

Please refer to FIG. 1, FIG. 2, and FIG. 3. The invention provides a circular knitting machine 20 capable of prompting a status of the circular knitting machine 20 in real time through a loop status of a tubular fabric during a knitting operation process. Firstly, basic structures of the circular knitting machine 20 are described. The circular knitting machine 20 includes a base 21, a needle cylinder 22 and a cloth rolling machine 23. The needle cylinder 22 rotates relative to the base 21 during the knitting operation process, so as to cooperate with a knitting needle structure (not shown in the figures, the knitting structure is a common knowledge in the art) on the base 21 to knit a tubular fabric 30, and the tubular fabric 30 rotates along with the needle cylinder 22. The cloth rolling machine 23 is mainly used for rolling the tubular fabric 30. The cloth rolling machine 23 rotates with the needle cylinder 22 relative to the base 21 during the knitting operation process. A structure of the cloth rolling machine 23 is as disclosed in CN114808260A, but is not limited to the above example. The cloth rolling machine 23 includes a cloth rolling rod 231 and a plurality of connecting rods 232 connected to the cloth rolling rod 231. The plurality of connecting rods 232 are displaced relative to the base 21 when the cloth rolling machine 23 rotates.

Please refer to FIG. 1, FIG. 2, and FIG. 3 again. The circular knitting machine 20 of the invention further includes a main camera module 24 and an auxiliary camera module 25. The main camera module 24 is fixed on the base 21. The main camera module 24 faces one side of the tubular fabric 30. More specifically, the tubular fabric 30 includes an outer side 301 and an inner side 302. In one embodiment, the main camera module 24 faces the outer side 301 of the tubular fabric 30. The main camera module 24 is controlled to take pictures of the tubular fabric 30 rotating with the needle cylinder 22. On the other hand, the auxiliary camera module 25 is fixed on the base 21, and the auxiliary camera module 25 is disposed close to the main camera module 24. Viewing at an angle from a bottom of the base 21 (as shown in FIG. 2), the auxiliary camera module 25 is not parallel to the main camera module 24, and a photographing range of the auxiliary camera module 25 overlaps the main camera module 24. Further, the main camera module 24 includes a first central axis 241, the auxiliary camera module 25 includes a second central axis 251, and the second central axis 251 intersects with the first central axis 241. Furthermore, the auxiliary camera module 25 and the main camera module 24 face a same side of the tubular fabric 30, that is, the auxiliary camera module 25 faces the outer side 301 of the tubular fabric 30. A startup timing of the auxiliary camera module 25 is different from that of the main camera module 24. A startup timing of the auxiliary camera module 25 only occurs when one of the plurality of connecting rods 232 passes between the main camera module 24 and the tubular fabric 30. The auxiliary camera module 25 is used to solve the problem that the main camera module 24 is blocked by one of the plurality of connecting rods 232 and cannot take pictures of the tubular fabric 30.

Figure 4:
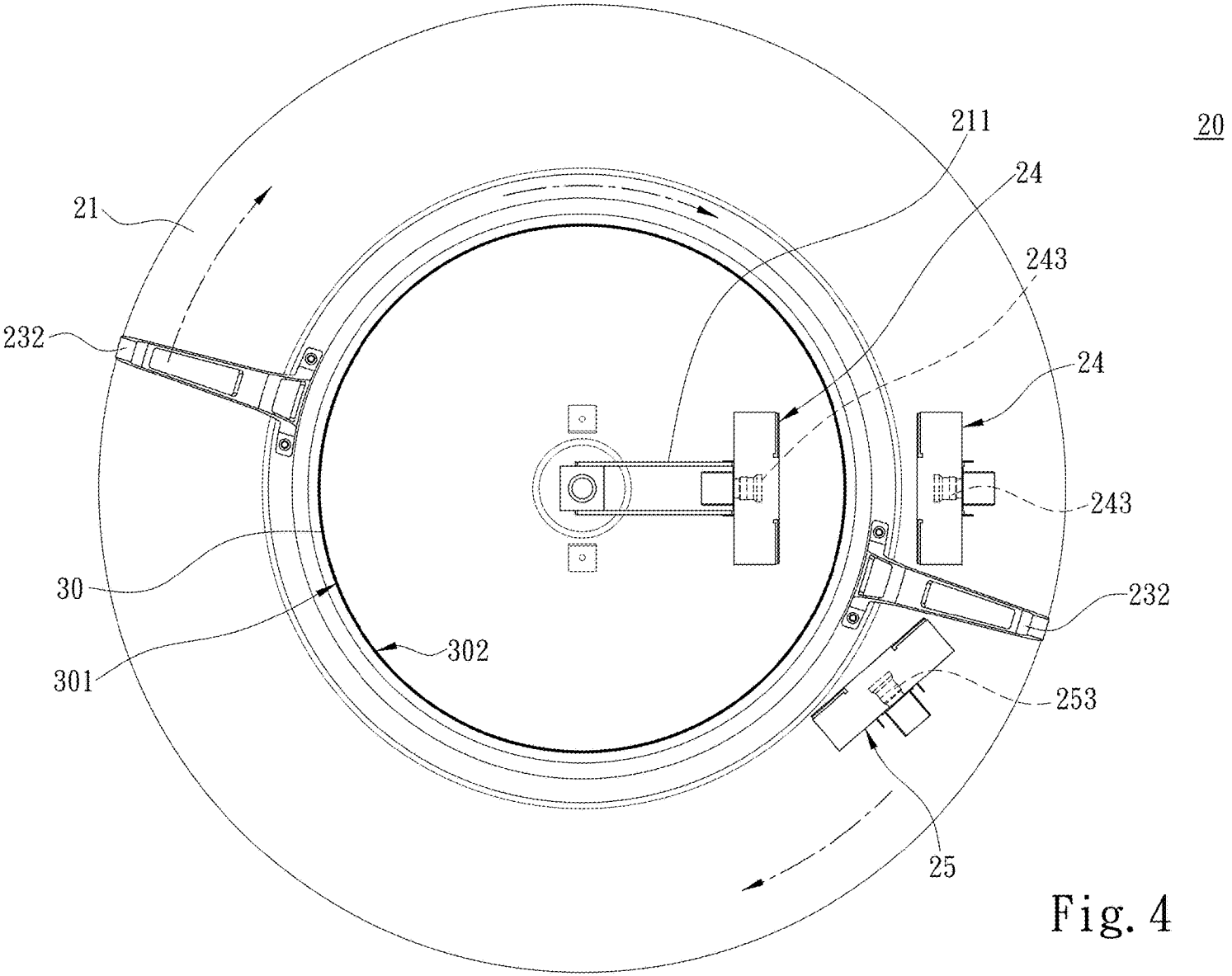
FIG. 4 is a bottom view of implementation of partial structures of the circular knitting machine of the invention.
Figure 5:
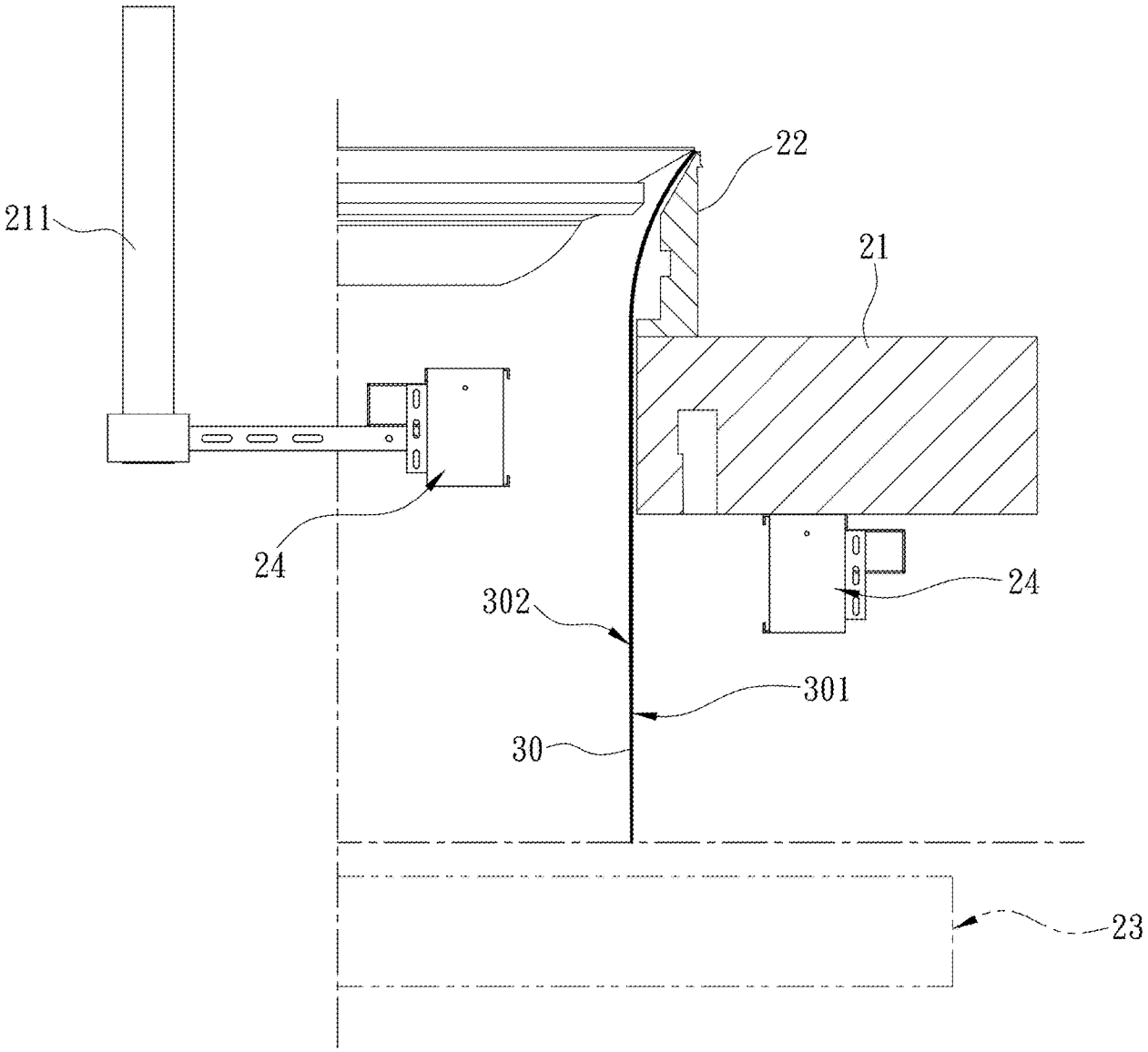
FIG. 5 is a cross-sectional view of implementation of partial structures of the circular knitting machine of the invention.

Based on the above, when the circular knitting machine 20 performs the knitting operation process, the tubular fabric 30 rotates with the needle cylinder 22, and the main camera module 24 is controlled to continuously photograph the tubular fabric 30, as shown in FIG. 4 and FIG. 5. Because the main camera module 24 is fixed, the cloth rolling machine 23 rotates with the needle cylinder 22, and when the cloth rolling machine 23 rotates to affect the main camera module 24 to photograph the tubular fabric 30, the auxiliary camera module 25 will be triggered to take at least one shot of the tubular fabric 30, as shown in FIG. 2 and FIG. 3. Data generated by the main camera module 24 and the auxiliary camera module 25 will be used to understand a status of knitting needles on the circular knitting machine 20. Data generated by the auxiliary camera module 25 compensates for a part of the main camera module 24 being unable to take pictures caused by being blocked by one of the plurality of connecting rods 232. Data generated by the main camera module 24 and the auxiliary camera module 25 will be used to understand a status of the knitting needles (not shown in the figures) on the circular knitting machine 20 through loops on the tubular fabric 30, in order to quickly respond with repair and avoid discovering defects in finished products only after the knitting operation process is completed. Furthermore, the invention further solves the resource waste problem caused by the prior art being incapable of checking a status of the knitting needles belonging to the circular knitting machine one by one, and only capable of replacing the knitting needles in batches.

It should be understood that the main camera module 24 of the invention does not always take pictures of the tubular fabric 30 and does not generate video data. The main camera module 24 is controlled to take pictures of the tubular fabric 30 during doffing.

Figure 6:
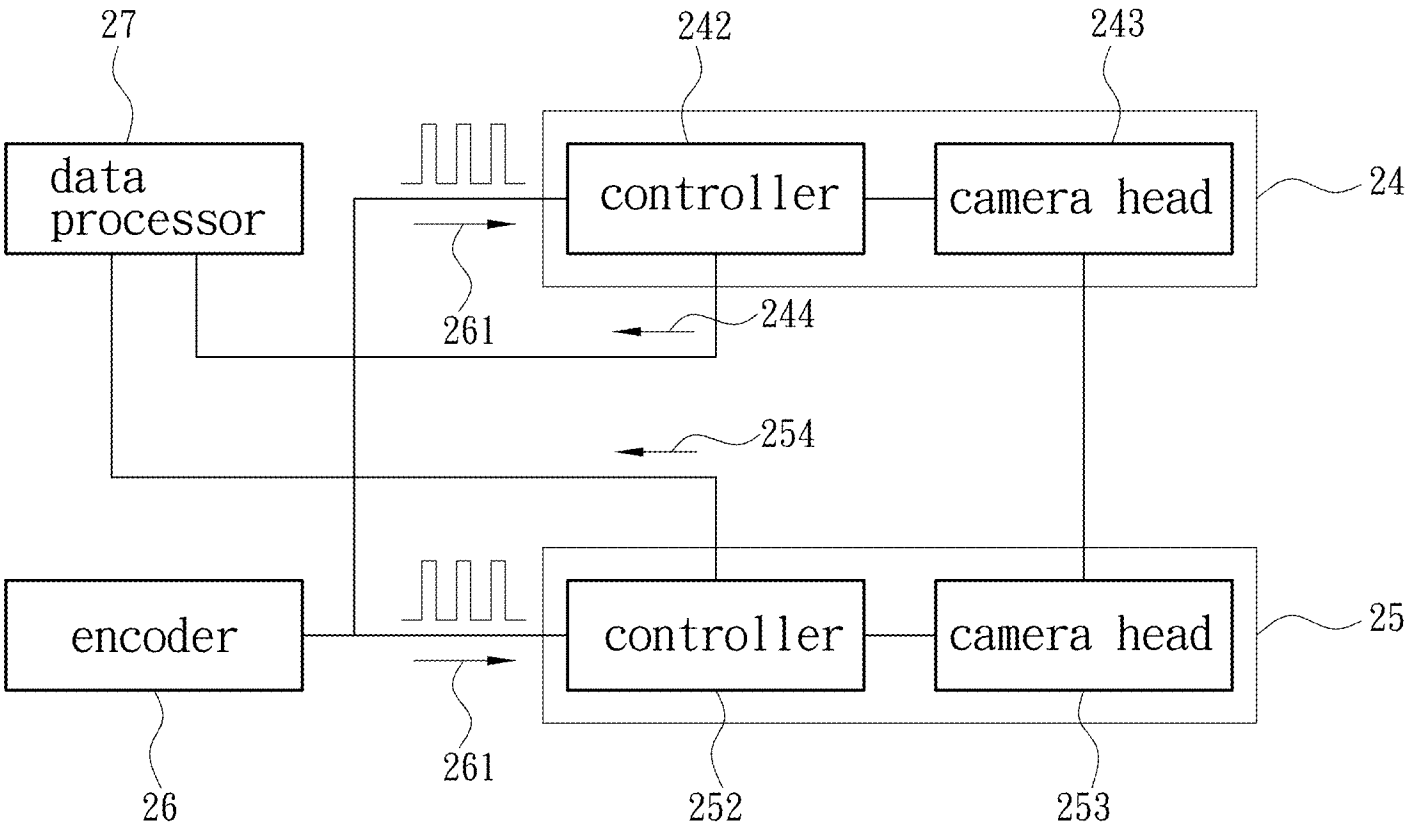
FIG. 6 is a unit schematic diagram of a first embodiment of the circular knitting machine of the invention.

Please refer to FIG. 6. In one embodiment, the circular knitting machine 20 includes an encoder 26 generating a plurality of pulse wave signals 261 when the needle cylinder 22 rotates. A plurality of shooting signals of the main camera module 24 and the auxiliary camera module 25 are generated based on counting the plurality of pulse wave signals 261. The main camera module 24 performs shooting at continuous intervals; specifically, when counting a number of the plurality of pulse wave signals 261 reaching a value, one shooting signals of the main camera module 24 is generated to control the main camera module 24 performing shooting. In one embodiment, in order to simplify difficulties in comparison of subsequent data, the plurality of shooting signals of the main camera module 24 are generated by counting a factor of a total number of the plurality of pulse wave signals 261 when the needle cylinder 22 performs one revolution. For example, a total number of the plurality of pulse wave signals 261 generated by the encoder 26 when the needle cylinder 22 performs one revolution is two thousand six hundred forty. A count value can be selected to be a value that is sufficient to divide two thousand six hundred forty, such as eighty-eight. In order to control a part of the main camera module 24 or the main camera module 24 taking a picture when every time eighty-eight pulse wave signals 261 are received. Based on the above, a number of shots taken by the main camera module 24 is a quotient obtained by dividing the count value by a total number of the plurality of pulse wave signals 261. Based on the above, for example, when the needle cylinder 22 performs one revolution, the main camera module 24 takes thirty shots. In addition, a value of shots taken by the main camera module 24 can evenly divide a central angle, thereby reducing an impact of overlapping shots on subsequent interpretation, and distinguishing a specific location of each shot, which facilitates rapid subsequent maintenance.

Please refer to FIG. 6. In one embodiment, the main camera module 24 includes a controller 242 and a camera head 243 controlled by the controller 242. The main camera module 24 is connected to the encoder 26 to obtain the plurality of pulse wave signals 261, based on the plurality of pulse wave signals 261, the controller 242 controls the camera head 243 to start shooting. On the other hand, the auxiliary camera module 25 comprises a controller 252 and a camera head 253 controlled by the controller 252. The auxiliary camera module 25 is connected to the encoder 26 to obtain the plurality of pulse wave signals 261. The controller 252 controls the camera head 253 to start shooting based on the plurality of pulse wave signals 261. In addition, the main camera module 24 and the auxiliary camera module 25 can also be controlled by an external control device. The external control device is connected to the encoder 26 to obtain the plurality of pulse wave signals 261, and controls the main camera module 24 and the auxiliary camera module 25 to take pictures based on the plurality of pulse wave signals 261.

Figure 7:
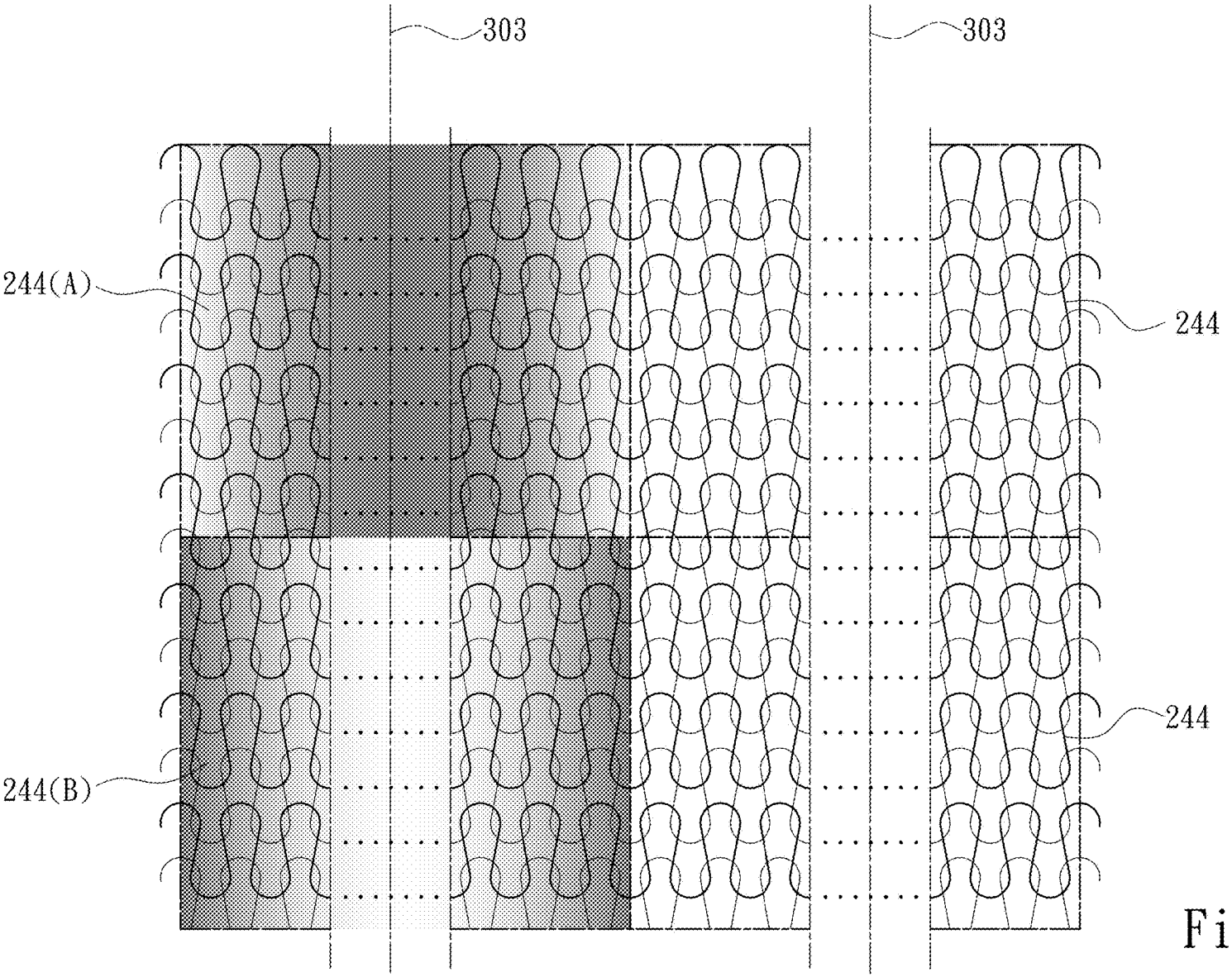
FIG. 7 is a schematic diagram of image data provided by a main camera module of the invention.
Figure 8:
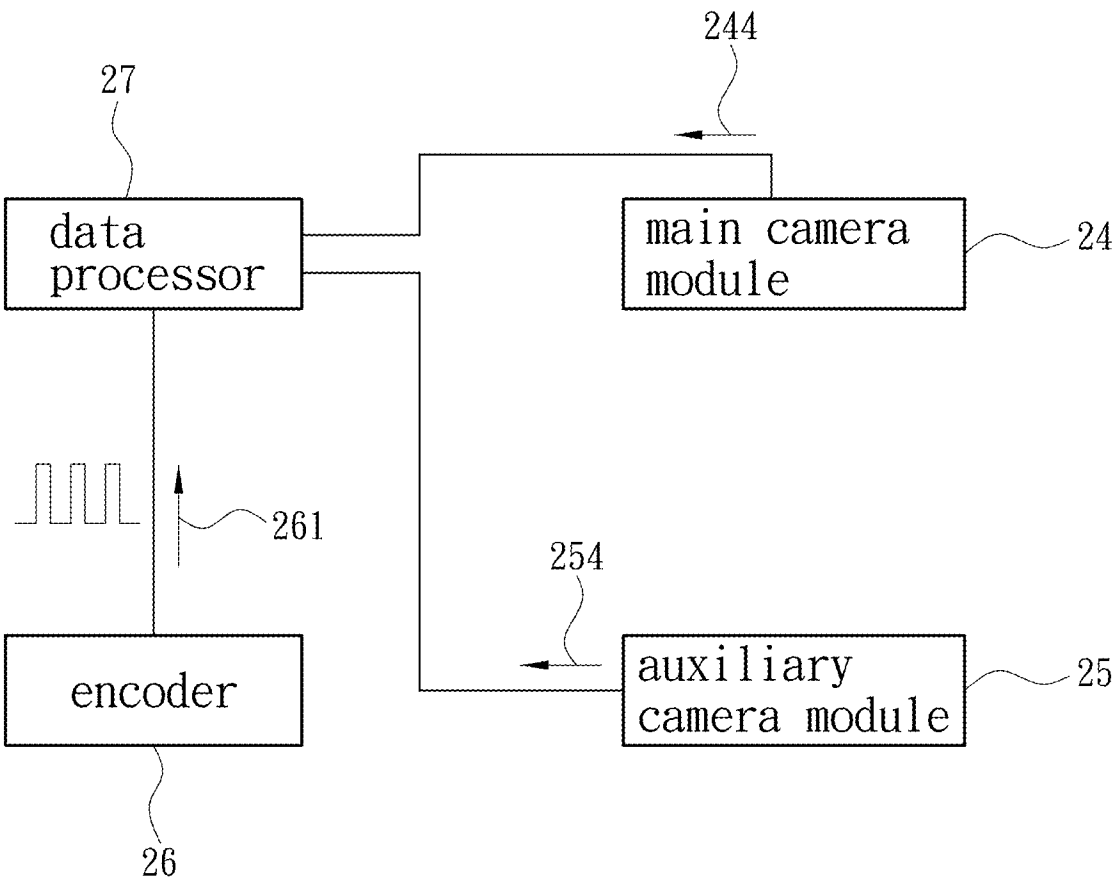
FIG. 8 is a unit schematic diagram of a second embodiment of the circular knitting machine of the invention.
Figure 9:
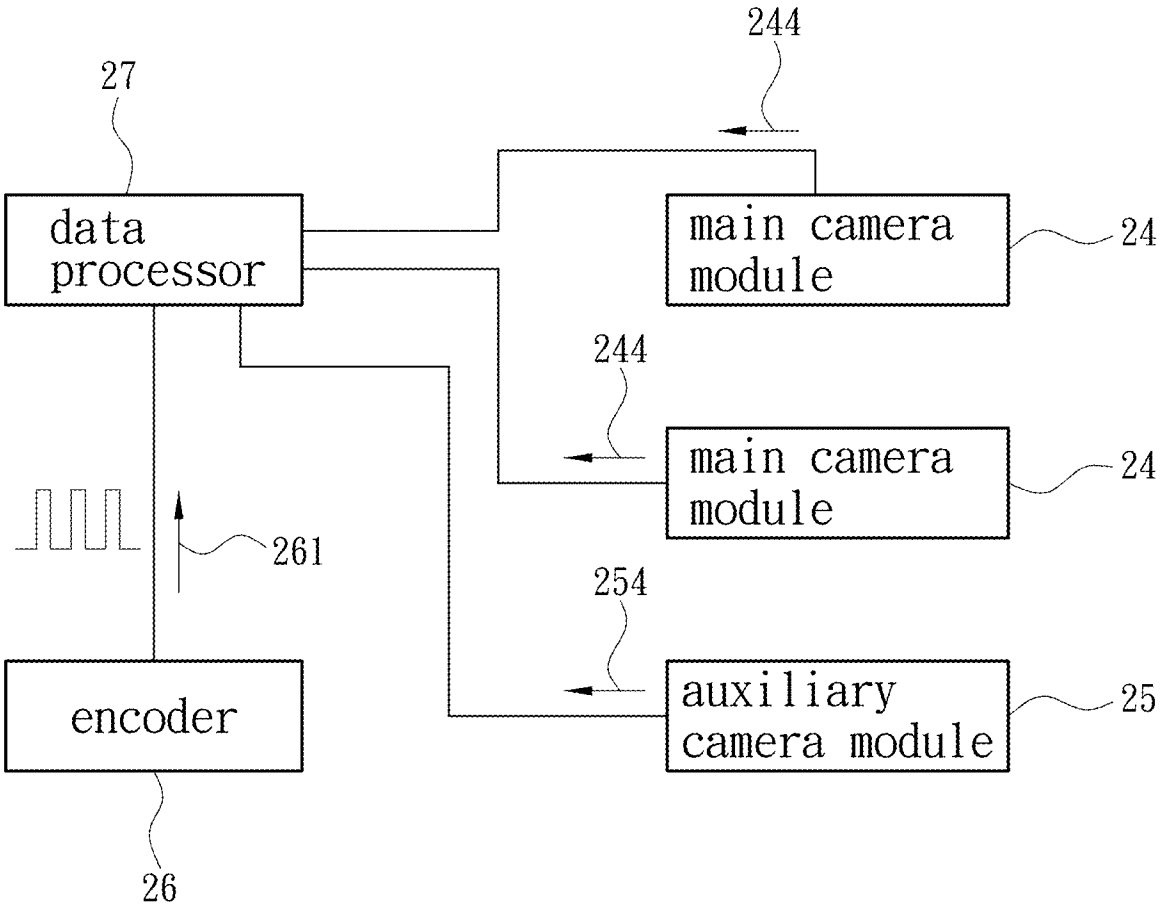
FIG. 9 is a unit schematic diagram of a third embodiment of the circular knitting machine of the invention.

Based on the above and referring to FIG. 6 and FIG. 7, data generated by the main camera module 24 and the auxiliary camera module 25 can be analyzed by an external computing device or a computing component on the circular knitting machine 20. In one embodiment, the circular knitting machine 20 includes a data processor 27 storing a plurality of operation programs. The data processor 27 is connected to the main camera module 24 and the auxiliary camera module 25. The data processor 27 receives a plurality of image data 244, 254 generated by shooting of the main camera module 24 and the auxiliary camera module 25, and uses the plurality of operation programs thereof to calculate and compare. Further, the data processor 27 causes each of the plurality of image data 244, 254 to perform image comparison only with the other one of the plurality of image data 244, 254 located on a same vertical line 303 of the tubular fabric 30. Specifically, if one (as shown in "A" in FIG. 7) of the plurality of image data 244 is the twenty-fourth image data shot by the main camera module 24 during one revolution of the needle cylinder 22, a comparator (as shown in "B" in FIG. 7) is the twenty-fourth image data shot by the main camera module 24 during a previous revolution of the needle cylinder 22. Two of the plurality of image data 244 are continuous on the vertical line 303. After comparing the two of the plurality of image data 244, the data processor 27 finds a difference and prompts a status of the circular knitting machine 20. The reason for the difference is that at least one of the knitting needles on the circular knitting machine 20 has a problem, and therefore knitting results are different. Comparison by the data processor 27 can be based on comparison of colored pixels or other image recognition operation programs. Furthermore, in one embodiment, the plurality of image data 254 generated by the auxiliary camera module 25 are independently determined, that is to say, the plurality of image data 254 generated by the auxiliary camera module 25 will not be integrated with the plurality of image data 244 generated by the main camera module 24 into an image representing an entire revolution state of the tubular fabric 30, thereby simplifying the plurality of operation programs of the data processor 27 and avoiding erroneous judgments caused by splicing images. Please refer to FIG. 8. In one embodiment, the data processor 27 can also be connected to the encoder 26 to receive the plurality of pulse wave signals 261, and control the main camera module 24 and the auxiliary camera module 25 to take pictures.

Furthermore, each of the plurality of image data 244 generated by the main camera module 24 comprises a plurality of loop images, and parts of the plurality of loop images located on the same column correspond to one of the knitting needles on the circular knitting machine 20. Thereby, the user can understand which one of the knitting needles has a problem and needs to be replaced by comparing the differences in the loop images of the image data 244. Additionally, numbers of the plurality of loop images included in every image data 244 generated by the main camera module 24 are similar or equal, so that the plurality of image data 244 can be compared with each other. Furthermore, each of the plurality of image data 254 generated by the auxiliary camera module 25 also comprises a plurality of loop images, and parts of the plurality of loop images located on the same column also corresponds to one of the knitting needles on the circular knitting machine 20. Additionally, numbers of the plurality of loop images included in every image data 244 generated by the auxiliary camera module 25 are similar or equal, so that the plurality of image data 244 can be compared with each other. Furthermore, when the needle cylinder 22 performs one revolution, a total longitudinal length of the plurality of loop images of the image data 244 and 254 generated by the main camera module 24 and the auxiliary camera module 25 have a proportional relationship with a length of the fabric drop amount of the circular knitting machine 20.

Please refer to FIG. 1, FIG. 2, FIG. 3 and FIG. 9. In one embodiment, the circular knitting machine 20 includes two main camera modules 24, and the two main camera modules 24 face the outer side 301 and the inner side 302 of the tubular fabric 30 respectively. The auxiliary camera module 25 is disposed adjacent to one of the two main camera modules 24 facing the outer side 301, and the auxiliary camera module 25 faces the outer side 301 of the tubular fabric 30. In one embodiment, the two main camera modules 24 are different horizontal heights. One of the two main camera modules 24 facing the inner side 302 is suspended in a range enclosed by the needle cylinder 22, which can also be said to be suspended in the tubular fabric 30. In one embodiment, the base 21 includes a suspension arm 211 provided thereon for disposing of one of the two main camera modules 24 facing the inner side 302 of the tubular fabric 30. Shooting control of the two main camera modules 24 is the same as mentioned above, and will not be described again here. In this embodiment, the foregoing structure can be used on the circular knitting machine 20 for knitting double-sided fabrics, thereby based on knitting results of the tubular fabric 30, the invention can be quickly determined whether the knitting needles or related matching knitting parts on the circular knitting machine 20 used for double-sided knitting are damaged or misoperated.

Furthermore, the plurality of image data 244 generated by the two main camera modules 24 are not limited to being compared together. That is to say, the plurality of image data 244 can be divided into a part on the outer side 301 and a part on the inner side 302 for separate operations. Of course, when the plurality of image data 244 generated by the two main camera modules 24 are compared together, the data processor 27 needs to correlate and compare two image data 244 opposite with each other representing a same part of the tubular fabric 30 through an operation program.

What is claimed is:

1. A circular knitting machine with real-time prompt of a knitting machine status, the circular knitting machine comprising a base, a needle cylinder rotating relative to the base during a knitting operation process, and a cloth rolling machine rotating with the needle cylinder relative to the base during the knitting operation process, the cloth rolling machine comprising a cloth rolling rod and a plurality of connecting rods connected to the cloth rolling rod, the connecting rods being displaced relative to the base when the cloth rolling machine rotating, the circular knitting machine comprising:

a main camera module, fixed on the base, the main camera module comprising a first central axis, the main camera module taking pictures of a tubular fabric rotating with the needle cylinder; and an auxiliary camera module, fixed on the base and disposed close to the main camera module, the auxiliary camera module comprising a second central axis intersecting with the first central axis, the auxiliary camera module and the main camera module facing a same side of the tubular fabric, a startup timing of the auxiliary camera module only occurring when one of the plurality of connecting rods passing between the main camera module and the tubular fabric;

wherein a status of the circular knitting machine is determined by data generated by the main camera module and the auxiliary camera module.

2. The circular knitting machine with real-time prompt of the knitting machine status as claimed in claim 1, wherein the circular knitting machine comprises an encoder generating a plurality of pulse wave signals when the needle cylinder rotates, and a plurality of shooting signals of the main camera module and the auxiliary camera module are generated based on counting the plurality of pulse wave signals.

3. The circular knitting machine with real-time prompt of the knitting machine status as claimed in claim 2, wherein the plurality of shooting signals of the main camera module are generated by counting a factor of a total number of the plurality of pulse wave signals when the needle cylinder performs one revolution.

4. The circular knitting machine with real-time prompt of the knitting machine status as claimed in claim 2, wherein a value of a number of shots taken by the main camera module can evenly divide a central angle, and exactly divisible a total number of knitting needles in the needle cylinder.

5. The circular knitting machine with real-time prompt of the knitting machine status as claimed in claim 1, wherein the circular knitting machine comprises a data processor, the data processor receives a plurality of image data provided by the main camera module and the auxiliary camera module, and the data processor is configured to perform an image comparison between one of the plurality of image data with another one of the plurality of image data located on a same vertical line of the tubular fabric.

6. The circular knitting machine with real-time prompt of the knitting machine status as claimed in claim 5, wherein each of the plurality of image data comprises a plurality of loop images, parts of the plurality of loop images located on a same column correspond to one of knitting needles on the circular knitting machine, and numbers of the plurality of loop images included in the plurality of image data generated by the main camera module are similar or equal to provide the plurality of image data being compared with each other, and numbers of the plurality of loop images included in the plurality of image data generated by the auxiliary camera module are similar or equal to provide the plurality of image data being compared with each other.

7. The circular knitting machine with real-time prompt of the knitting machine status as claimed in claim 6, wherein when the needle cylinder performs one revolution, a total longitudinal length of the plurality of loop images of the image data respectively generated by the main camera module and the auxiliary camera module have a proportional relationship with a length of the fabric drop amount of the circular knitting machine.

8. The circular knitting machine with real-time prompt of the knitting machine status as claimed in claim 1, wherein the circular knitting machine comprises another main camera modules, the two main camera modules face an outer side and an inner side of the tubular fabric respectively, one of the two main camera modules facing the outer side is disposed adjacent to the auxiliary camera module, and the auxiliary camera module faces the outer side of the tubular fabric.

9. The circular knitting machine with real-time prompt of the knitting machine status as claimed in claim 8, wherein the two main camera modules are different horizontal heights.

10. The circular knitting machine with real-time prompt of the knitting machine status as claimed in claim 9, wherein the base comprises a suspension arm provided thereon for disposing one of the two main camera modules facing the inner side of the tubular fabric.

11. The circular knitting machine with real-time prompt of the knitting machine status as claimed in claim 8, wherein the circular knitting machine comprises a data processor receiving a plurality of image data provided by the two main camera modules and the auxiliary camera module, and the data processor is configured to perform an image comparison between one of the plurality of image data with another one of the plurality of image data located on a same vertical line of the tubular fabric.

12. The circular knitting machine with real-time prompt of the knitting machine status as claimed in claim 11, wherein each of the plurality of image data comprises a plurality of loop images, parts of the plurality of loop images located on a same column correspond to one of knitting needles on the circular knitting machine, and numbers of the plurality of loop images included in the plurality of image data generated by the two main camera modules are similar or equal to provide the plurality of image data being compared with each other, and numbers of the plurality of loop images included in the plurality of image data generated by the auxiliary camera module are similar or equal to provide the plurality of image data being compared with each other.

13. The circular knitting machine with real-time prompt of the knitting machine status as claimed in claim 12, wherein when the needle cylinder performs one revolution, a total longitudinal length of the plurality of loop images of the image data respectively generated by the two main camera modules and the auxiliary camera module have a proportional relationship with a length of the fabric drop amount of the circular knitting machine.

* * * * *